US005975002A

United States Patent [19]

Rieger

[11] Patent Number: 5,975,002

[45] Date of Patent: Nov. 2, 1999

[54] STORAGE SYSTEM FOR MARINE CRAFT

[75] Inventor: Paul J. Rieger, Arrington, Tenn.

[73] Assignee: Triton Boat Company, L.P., Ashland City, Tenn.

[21] Appl. No.: 08/900,227

[22] Filed: Jul. 24, 1997

[51] Int. Cl.[6] ..... B63B 17/00

[52] U.S. Cl. ..... 114/343

[58] Field of Search ..... 114/343, 357, 114/364, 255; 43/57.1, 54.1; D3/260; D12/317

[56] References Cited

U.S. PATENT DOCUMENTS

| | | | |
|---|---|---|---|
| D. 335,577 | 5/1993 | Malmanger et al. | D3/260 |
| 3,674,170 | 7/1972 | Thorpe et al. | 220/18 |
| 3,824,733 | 7/1974 | Cordell, Jr. | 43/54.5 |
| 3,834,340 | 9/1974 | Thorpe | 114/201 |
| 4,170,801 | 10/1979 | Ward . | |
| 4,513,526 | 4/1985 | Grace | 43/57.2 |
| 4,628,628 | 12/1986 | Burgin et al. | 43/26 |
| 4,662,303 | 5/1987 | Duff | 114/343 |
| 4,671,009 | 6/1987 | Faunce | 43/54.1 |
| 4,827,864 | 5/1989 | LaMontagne et al. | 114/343 |
| 4,974,537 | 12/1990 | Martin | 114/364 |
| 5,048,447 | 9/1991 | Vicari | 114/255 |
| 5,127,355 | 7/1992 | Magers et al. | 114/255 |
| 5,421,283 | 6/1995 | Bruggemann et al. | 114/357 |
| 5,582,313 | 12/1996 | Envall | 220/4.28 |
| 5,704,158 | 1/1998 | Whiteaker | 43/57.1 |

OTHER PUBLICATIONS

Brochure, Gambler Bass Boats, Maritec Industries, Inc., 5980 Lakehurst Drive, Orlando, FL 32819—No Date.

*Primary Examiner*—Ed Swinehart
*Attorney, Agent, or Firm*—Luedeka, Neely & Graham, PC

[57] ABSTRACT

A recessed storage compartment is integrally formed into the deck of a boat for containment of tackle storage trays and other articles. The storage compartment includes a container having four side walls with upper and lower edges and a bottom wall attached to the lower edges of the side walls. Oppositely oriented ones of the side walls include a plurality of troughs and guides extending from top to bottom for vertical containment of the storage trays where the distances separating the troughs of one side wall from corresponding troughs of the oppositely oriented side wall are greater than a dimension of the trays, and the distances separating the guides of one side wall from corresponding ones of the opposite side wall are less than the same dimension of the trays. A raised edge adjacent the upper edges of the side walls inhibits intrusion of water into the container. A hinged lid is movable between a fully open position providing access to the compartment and a fully closed position in which access to the compartment is restricted. Minimal size of the troughs and guides enables the compartment to be used as a general utility box when not filled with trays.

32 Claims, 4 Drawing Sheets

STORAGE SYSTEM FOR MARINE CRAFT

TECHNICAL FIELD

The present invention relates generally to containers for storing equipment onboard a marine craft. More particularly, the invention relates to a storage container which is integrally formed into the deck of a bass boat and uniquely configured to accommodate organized storage of tackle trays.

BACKGROUND AND SUMMARY OF THE INVENTION

Sport fishing has long been a favorite recreational activity for outdoor enthusiasts around the world. Of the many species of fish which are pursued, bass is one of the most popular. Bass are generally very selective when it comes to food. To entice a bass to strike, an angler typically must select the proper lure for the given conditions and present the lure to the fish in such a manner that the lure is made to appear as an irresistible meal. Effective lure selection and presentation are skills which few novice bass anglers possess. Instead, such skills are generally acquired only after prolonged exposure to the sport. When a strike occurs, the angler is challenged to skillfully hook and retrieve the combative fish. The beauty of the outdoors, the skill and challenge associated with lure selection and lure presentation techniques, and a fierce desire of bass to avoid capture when hooked are all characteristics which make the sport of bass fishing highly popular and challenging.

Many specialized products have evolved over the years to accommodate bass anglers. Specialized marine craft commonly referred to as "bass boats" have evolved to provide the bass angler with a steady, speedy, sporty platform to fish from. Bass boats are designed to provide functionality, convenience, and in many cases, style. A typical bass boat will include a large outboard motor for rapid transport of the angler to select fishing holes and a forward platform on which the angler stands to make repeated casts toward suspected fish-holding structure. A bow-mounted, electric trolling motor is commonly used to navigate the bass boat through the water and to position the boat at a desired location from which casts can be made. Various storage areas are commonly incorporated into the deck to accommodate storage of items such as fishing rods and life jackets. Most bass boats also include one or more live wells for containment of bait or captured fish.

Another specialized product which is rapidly gaining popularity among bass anglers are compact, compartmentalized, plastic storage trays for organized storage of lures and other tackle. An example of such a tackle storage tray are trays available under model no. 3700 from Plano Molding Company of Plano, Ill. These storage trays are small, lightweight, accessible, and generally exhibit improved storage efficiency and compactness as compared to conventional tackle boxes. Such storage trays are also desirable for their ability to contain lures and other tackle within their respective compartments even when the storage tray is turned upside-down, thus eliminating one of the more bothersome disadvantages of a typical conventional tackle box. Increasingly, anglers are eliminating their bulky, cumbersome, foldout style of tackle boxes and are opting instead to store their lures and other tackle in the new compact storage trays. Because of the many lures, hooks, weights, and other tackle which bass anglers normally use, most anglers will typically utilize several of these compact storage trays in which to store their tackle. In many instances, bass anglers elect to dedicate individual trays for storage of a particular type of lure or other tackle.

Various portable carriers have also been developed to help anglers transport and organize the compact storage trays. One example is a gear bag available under model no. 3370 from Plano. This particular carrier is made of a soft fabric and includes a shoulder strap and a zippered compartment for storage of the model no. 3700 storage trays. Another example of a carrier bag of this type is a hard plastic container available under the trade name StowAway Super-Sport from Plano.

While such compact storage trays provide advantages over conventional tackle boxes, some of those advantages are lost by requiring the angler to utilize a carrier for transporting the storage boxes to and from the boat. In this manner, the combination of storage trays and carrier provide little improvement over conventional tackle boxes. Also, as with conventional tackle boxes, the combination of storage trays and carrier is an obstruction within the limited deck space available to the angler.

Accordingly, it is an object of the invention to provide a storage device and system which avoids disadvantages of previous storage devices.

Another object of the invention is to provide a storage system which is integrally formed into a deck portion of a marine craft.

Yet another object of the invention is to provide a storage system of the character described which is suitable for storage of modular tackle trays and/or other items.

A further object of the invention is to provide a system of the character described which is recessed into a deck portion of a boat.

A further object of the invention is to provide a system of the character described which enables storage of modular tackle trays in an organized manner.

A still further object of the invention is to provide a system of the character described which protects stored items from exposure to the elements.

An additional object of the invention is to provide a system of the character described which is capable of general purpose storage as well as specific storage of modular tackle trays.

Yet another object of the invention is to provide a system of the character described which is economical, convenient to use, and does not detract from the aesthetics of a boat.

With regard to the foregoing and other objects, the invention provides a storage system for a marine craft, such as a bass boat. The system includes a recess defined in a deck portion of the marine craft and a plurality of storage modules for which are removably positionable within the recess. Examples of storage modules, or trays which are suitable for use with the invention include generally rectangular trays available under model no. 3700 from Plano Molding Company of Plano, Ill. In one aspect, the recess includes a bottom wall spaced below the deck surface, a plurality of sidewalls extending from the bottom wall toward the deck surface and terminating adjacent and below the deck surface, and module retainers located within the recess for slidably receiving the modules and for maintaining the modules in a desired orientation within the recess below the deck surface.

In another aspect of the invention, each of two opposed side walls are separated from each other by a distance sufficient to enable one or more of the modules to be positioned between the two walls. Each of these two walls include a plurality of guides protruding from the side wall and extending vertically from the top of the wall toward the bottom. Each of the guides is spaced apart, one from another, to provide alternating guides and troughs sized to receive at least a portion of one of the modules. For each guide and trough of one side wall there is an oppositely oriented guide and trough on the other side wall. Oppositely oriented troughs and guides are separated by distances sufficient to enable the modules to be slidingly fitted and contained between oppositely oriented troughs. A lid which is used to cover the container is movable between a fully open position providing access to the container and a fully closed position in which access into the container is restricted. When fully closed, the lid is substantially flush with the deck portion of the marine craft so as to not interfere with the angler's footing and to provide an aesthetically pleasing appearance.

To inhibit intrusion of water into the container, a raised edge may be provided adjacent the upper edges offside walls. Additionally, in one embodiment the lid is attached to the deck by at least one hinge. The lid may also include a handle for opening and closing the lid.

In another aspect of the invention, a fishing tackle storage system is provided. The system includes a plurality of storage trays for storing fishing tackle, including lures, where each of the trays has a first end opposite a second end. A storage tray container is also provided. The container, which has an upper edge adjacent the deck of a marine craft, is recessed into the deck of the marine craft to a depth at least as great as a dimension of a storage tray. The container includes a first plurality of guides in opposed relation to a second plurality of guides. Each of the first plurality of guides are in a spaced apart relation to receive and contain the first ends of the storage trays, and each of the second plurality of guides are in a spaced apart relation to receive and contain the second ends of the storage trays. A lid covers the container. The lid provides access to the container when open and restricts access when closed.

The present invention also provides a boat having a deck with a container recessed into the deck. As described above, the container includes a plurality of side walls and a bottom wall for storage of tackle trays and other items. A lid is provided for covering the container, as previously described.

BRIEF DESCRIPTION OF THE DRAWINGS

The above and other features, aspects and advantages of the present invention will now be discussed in the following detailed description and appended claims considered in conjunction with the accompanying drawings in which:

DETAILED DESCRIPTION OF A PREFERRED EMBODIMENT

Figure 1:
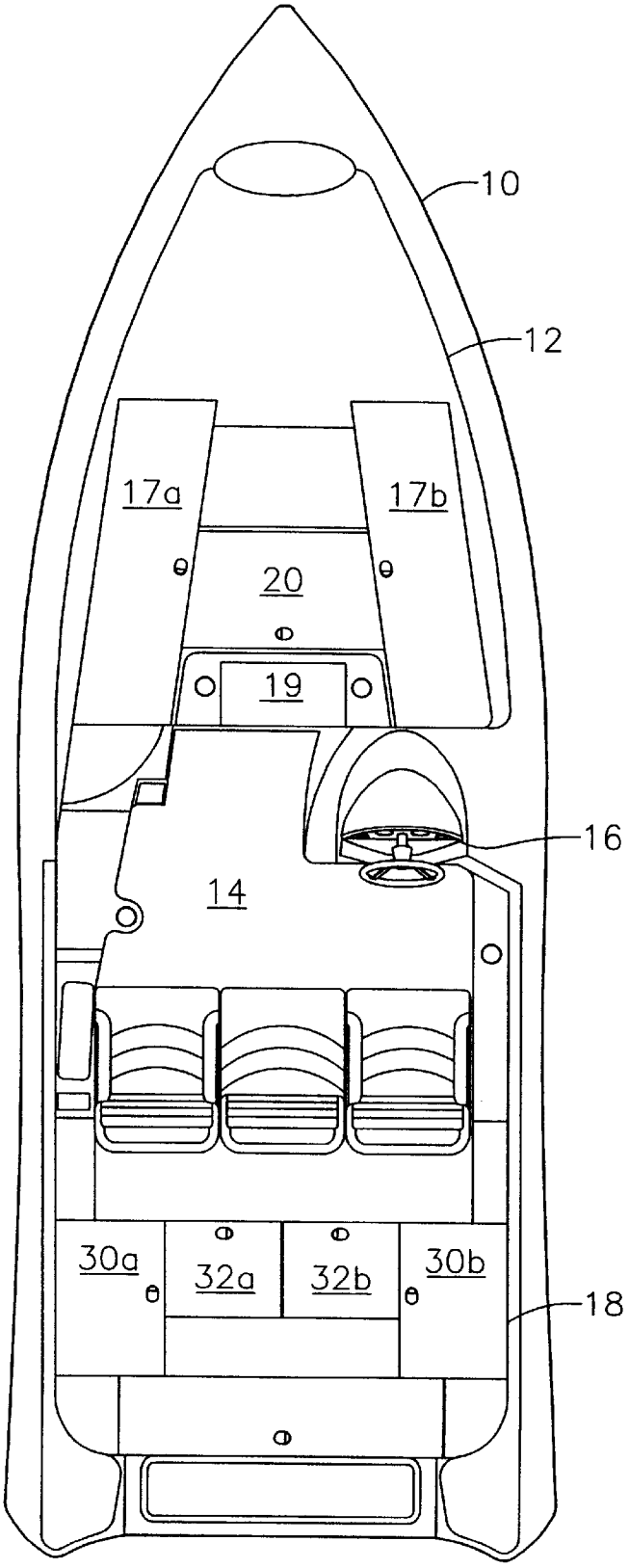
FIG. 1 is a top view of a bass boat having storage compartments in accordance with the invention, including a storage compartment located in the forward casting deck and two storage compartments located in the rear casting deck.
Figure 2:
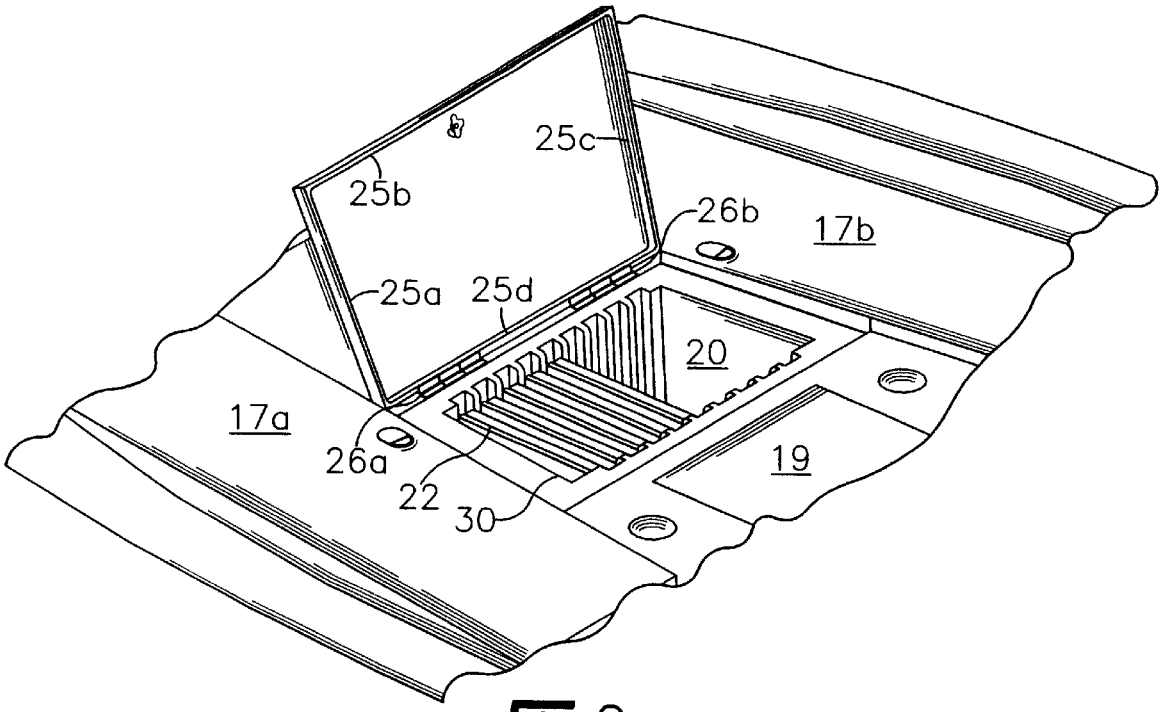
FIG. 2 is a sectional view of the forward casting deck storage compartment of FIG. 1 with the lid in the open position.

With reference now to the drawings in which like reference characters designate like or similar parts throughout the several views, FIG. 1 illustrates a bass boat 10 having a forward casting deck 12 into which is recessed a storage compartment 20 configured for organized containment of tackle storage trays 22 (FIG. 2). Trays suitable for use in the invention are preferably clear plastic trays available under model no. 3700 from Plano Molding Company of Plano, Ill. The storage compartment 20, having a storage area defined by a container 50, can be positioned at a variety of locations within the boat 10, including the forward casting deck 12, the rear casting deck 18, or both. In a preferred location of a storage compartment 20 for a particular style of boat 10 as shown in FIG. 1, the storage compartment 20 is located centrally to the forward casting deck 12 between rod boxes 17*a*, 17*b* and immediately forward of an integral ice chest 19.

If desired, the boat's understructure may be configured to accommodate a desired placement of the container 50. Also, as described herein, the container 50 is received within a recess. Alternatively, the compartment 20 may be formed in the configuration of the container 50.

The position of the compartment 20 will vary depending on boat design and size. For the boat 10 shown in FIG. 1, positioning the compartment 50 centrally within the boat 10 and proximate to a non-elevated area (shown generally at 14) intermediate the control console 16 and forward casting deck 12 provides excellent accessibility to the compartment 20 for an angler casting from the forward casting deck. For an angler casting from the rear casting deck 18, storage compartments in accordance with the invention can be located in the rear casting deck 18, such as the two storage compartments 30*a*, 30*b* located outboard of live wells 32*a*, 32*b*, respectively.

As best shown in FIG. 2, the compartment 20 is preferably covered by a lid 24. The lid 24 is preferably made of a strong material, such as fiberglass, and is suitable for supporting the weight a person while standing on or walking across the deck 12. Preferably, the lid 24 is movably attached to the deck 12, such as by a pair of piano hinges 26*a*, 26*b*. Alternatively, a single hinge or other attachment mechanism may be used to movably attach the lid 24 to the deck 12 or other supporting structure. Hinges 26*a*, 26*b* enable the lid 24 to be moved between a fully open position (shown in FIG. 2) providing access to the compartment 20, and a fully closed position (shown in FIG. 3) in which access to the compartment 20 is restricted.

Figure 3:
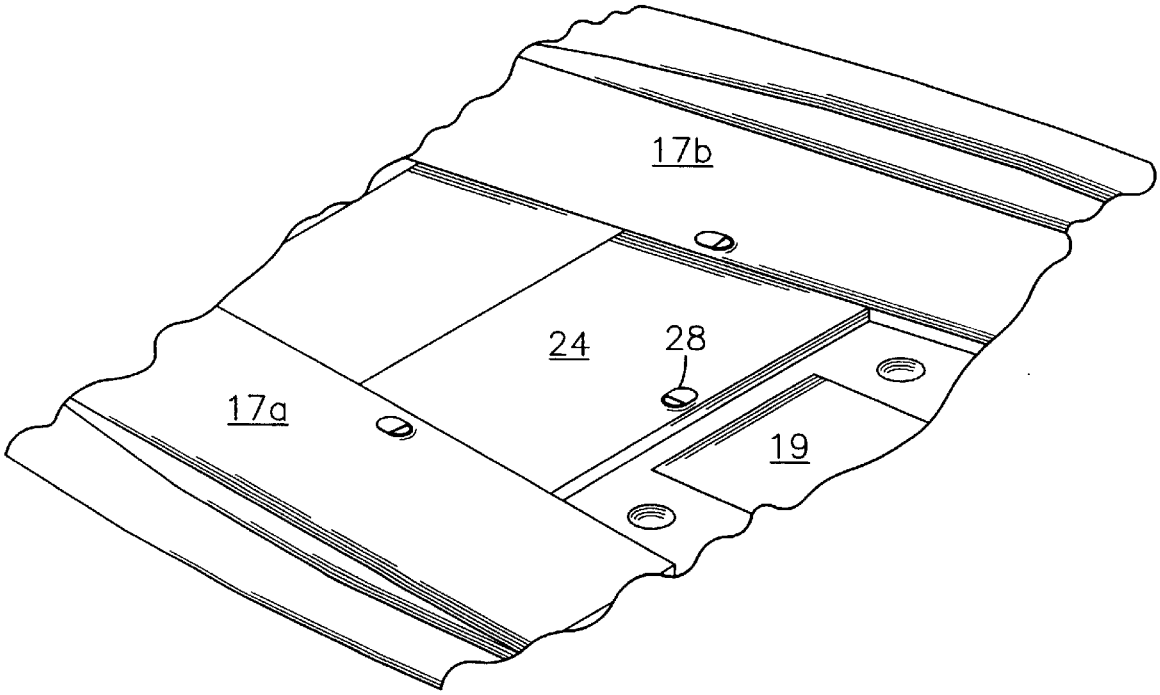
FIG. 3 is a sectional view of the storage compartment of FIG. 2 with the lid in the closed position.

As can be seen in FIG. 3, the lid 24 is preferably substantially flush with the deck 12 when fully closed so that it blends in aesthetically with the visual lines of the boat and does not interfere with the angler's footing. Additionally, when the lid 24 is closed, the lid 24 covers the compartment 20 so as to inhibit water intrusion into the compartment 20. The lid 24 is also suitable as a portion of the deck surface on which the bass angler can walk. The lid 24 also preferably includes a handle 28 for opening the lid 24 and, if desired, the handle may incorporate a lock to inhibit unauthorized access to the compartment 20.

Water intrusion into the compartment 20 may be further inhibited by providing a raised edge 30 about the perimeter of the compartment opening, as shown in FIG. 2. Water which settles onto surface 32 immediately beneath the deck surface 12 is discouraged from entering the compartment 20 by the raised edge 30. To prevent damage to the raised edge 30, the lid edges 25*a–d* may be extended from the lid 24 so that when the lid 24 is closed, the lid 24 does not come into contact with the raised edge 30.

Figure 4:
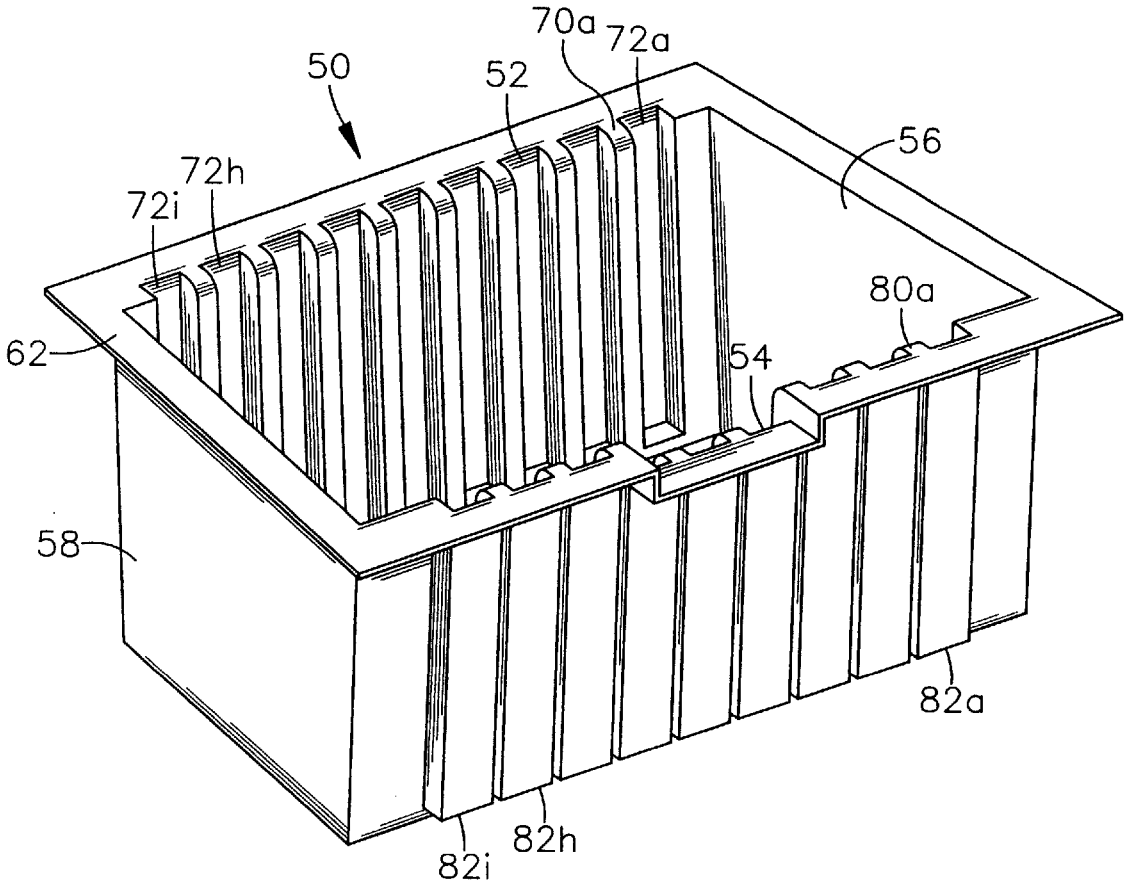
FIG. 4 is a perspective view of a storage compartment container in accordance with the invention.
Figure 5:
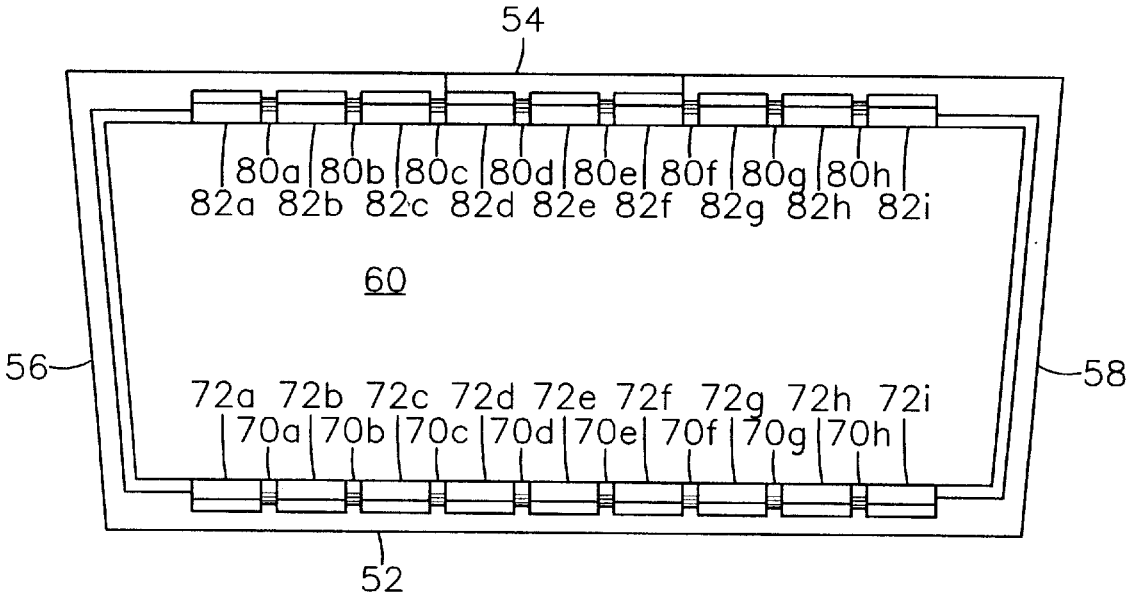
FIG. 5 is a top view of the container of FIG. 4.
Figure 6:
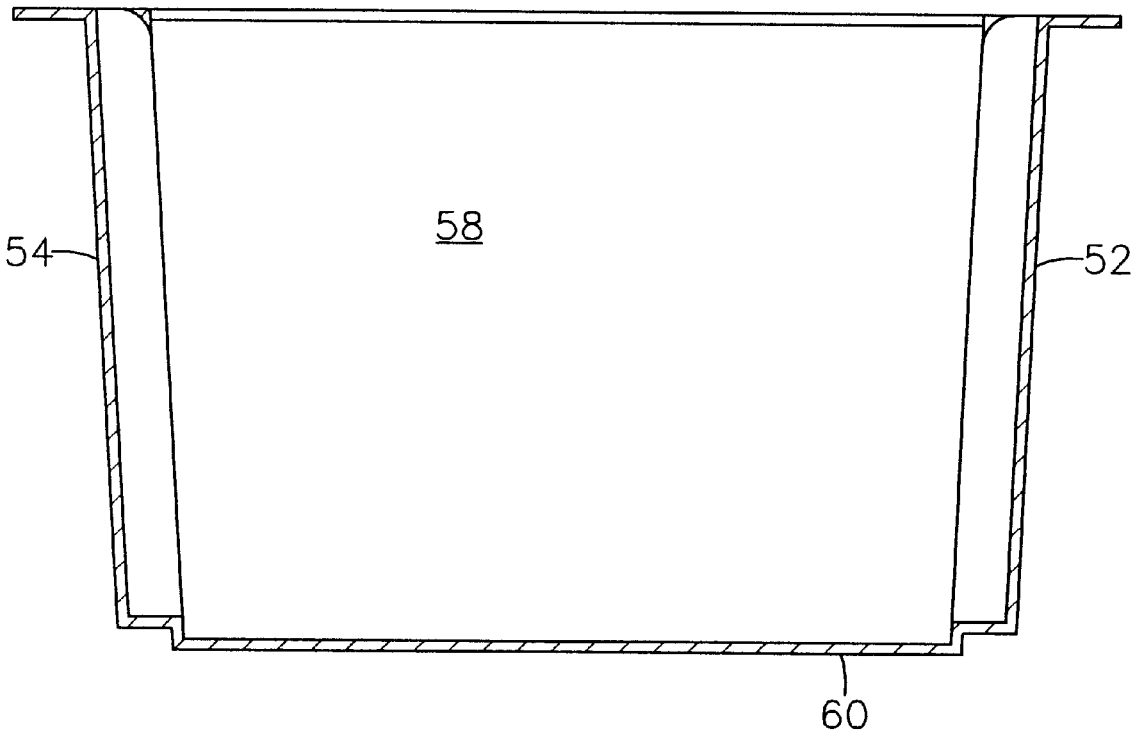
FIG. 6 is a cross-sectional view of the container of FIG. 4.

With reference to FIGS. 4, 5, and 6, a preferred internal configuration of the compartment 20 will now be described.

The storage area of the compartment 20 is preferably defined by a substantially rectangular box, or container 50 having four side walls 52–58 extending substantially vertically into the deck 12 and a bottom wall 60 which is connected to the lower edges of each of the side walls 52–58 and is substantially parallel to the deck surface. It will be understood, however, that the container 50 may be provided in various geometric shapes, such as polygons, ovals, circles, or even decorative designs such as the outline of a fish.

A flange 62 may be formed along the upper edges of the four vertical walls 52–58. The flange 62 is preferably attached adjacent to surface 32 (FIG. 2) to aid in supporting the container 50 within the deck 12. Additional support is preferably provided by attaching the vertical walls 52–58 with fiberglass to the boat's understructure during boat construction. The container 50 is preferably made of relatively rigid and durable material, such as polyethylene or fiberglass which is suitable for use in a marine environment.

As best illustrated in the perspective view of FIG. 4 and the top view of FIG. 5, side walls 52 and 54 may include a plurality of oppositely oriented troughs separated by guides. For example, side wall 52 includes a first trough 72*a* which is separated from a second trough 72*b* by guide 70*a*. Trough 72*b* is in turn separated from troughs 72*a* and 72*c* by guides 70*a* and 70*b*, respectively. Similarly for side wall 54, a first trough 82*a* is separated from a second trough 82*b* by guide 80*a*, and guide 80*b* separates troughs 82*b* and 82*c*. For each trough 72*a–i* and guide 70*a–h* formed in side wall 52, there is a corresponding trough 82*a–i* and guide 80*a–h* formed in side wall 54.

The distance separating a trough of one of side walls 52, 54 from a corresponding trough of the opposite side wall is preferably greater than the length or width (depending on tray orientation) of a storage tray 22, and the distance separating a guide of one of side walls 52, 54 from a corresponding guide of the opposite side wall is less than the same dimension of the storage tray 22. Also, the distance separating adjacent guides of each side wall 52, 54 is greater than the height of the storage tray 22. In this manner, the configuration of troughs 72*a–i*, 82*a–i* and guides 70*a–h*, 80*a–h* is such that individual storage trays 22 can be vertically stored and contained within the troughs of the container 50. For example, a storage tray 22 can be vertically stored in the slot created by troughs 72*a* and 82*a*. Likewise, a second tray 22 can be stored in the slot created by trough 72*b* and 82*b*. For the container 50 of FIGS. 4, 5, and 6, a maximum of nine storage trays 22 can be vertically stored. It will be understood, however, that the number of guides and troughs can vary to accommodate more or less storage trays 22. Additionally, the height of each of the side walls 52–58 is at least as great as a dimension of a storage tray 22, such as the length or width of the tray 22 (again, depending on tray orientation), so that the tray 22 is contained within the compartment 20 when the lid 24 is closed.

It will be appreciated that by vertically organizing the storage trays 22 within the container 50 as described above, each tray 22 can be retrieved individually without having to move other trays 22. The vertical arrangement of the clear plastic trays 22 also enables the angler to view all of the trays 22 at a glance since the trays 22 are not stacked one on top of another.

The dimensions of the container 50 can be varied to accommodate the various sizes and shapes of storage trays 22. For the purpose of an example, the trays available under model no. 3700 from Plano have a length of about 13¾ inches, a width of about 9⅛ inches, and a height of about 2 inches. To accommodate storage trays of this dimension, the distance separating troughs 72*a–i* from troughs 82*a–i* is preferably slightly greater than about 13¾ inches, while the distance separating guides 70*a–h* from guides 80*a–h* is preferably slightly less than 13¾ inches. In a preferred embodiment, each of the guides 70*a–h*, 80*a–h* extends about 0.45 inches beyond its side wall 52, 54, and the distance separating adjacent guides of the same side wall 52, 54 is about 2.43 inches. Each of the side walls 52–58 are preferably about 12.5 inches in height. These container dimensions provide sufficient spacing to enable the model no. 3700 storage trays available from Plano to be easily inserted into and retrieved from the container 50. That is, the troughs are preferably sized to slidingly receive the trays 22 without significant friction or play. An added advantage of a container 50 which is configured in accordance with the invention is that the minimal size of the guides and troughs enables the container 50 to be used as a general utility box when not filled with trays 22.

It is contemplated, and will be apparent to those skilled in the art from the foregoing specification, drawings, and examples that modifications and/or changes may be made in the embodiments of the invention. Accordingly, it is expressly intended that the foregoing are only illustrative of preferred embodiments and modes of operation, not limiting thereto, and that the true spirit and scope of the present invention be determined by reference to the appended claims.

What is claimed is:

1. A storage system forming a portion of a marine craft having a deck with a deck surface, the system comprising:

a nonremovable recess defined in the deck and a plurality of storage modules removably positionable within the recess below the deck, said recess including:

a bottom wall spaced below the deck surface, a plurality of sidewalls extending from the bottom wall toward the deck surface, said sidewalls terminating adjacent and below the deck surface, and module retainers located within the recess for slidably receiving the modules and for maintaining the modules in a desired orientation within the recess below the deck surface.

2. The storage system of claim 1, further comprising a raised edge adjacent said plurality of side walls and extending above said deck surface to inhibit intrusion of water into the container.

3. The storage system of claim 1, further comprising a lid for covering said recess.

4. The storage system of claim 3 wherein said lid is movably attached to the deck, said lid being movable between a fully open position providing access to the recess and a fully closed position restricting access to the recess.

5. The storage system of claim 1 wherein said recess and said modules are substantially rectangular in configuration.

6. The storage system of claim 1 wherein said bottom wall is substantially parallel to the deck surface and each of said plurality of side walls is substantially perpendicular to the bottom wall.

7. The storage system of claim 1 wherein said module retainers include projections extending perpendicularly from at least two side walls.

8. The storage system of claim 1 wherein said plurality of sidewalls is permanently attached by fiberglass to the understructure of the marine craft.

9. A storage system forming a portion of a marine craft, the system comprising:

a nonremovable recess defined in a deck portion of a marine craft and a plurality of modules for containing articles to be stored and removably positionable within the recess, wherein said recess includes, a first side wall having an upper edge adjacent the surface of the deck portion and a lower surface extending substantially vertically from the upper edge into the deck portion of the marine craft, a second side wall opposite and substantially parallel to said first side wall and separated from said first side wall by a first distance defining a length of the recess, said second side wall having an upper edge adjacent the surface of the deck portion and a lower surface extending substantially vertically from the upper edge into the deck portion of the marine craft, a third side wall having an upper edge adjacent the surface of the deck portion and a lower edge extending substantially vertically from the upper edge into the deck portion of the marine craft, said third side wall being connected to said first and second side walls, said third side wall including a first plurality of guides protruding from and extending substantially vertically from the upper edge toward the lower edge of the third side wall, wherein each of said guides is separated one from another by a second distance to produce alternating guides and troughs sized to receive at least a portion of one of the modules, a fourth side wall opposite and substantially parallel to said third side wall, said fourth side wall being connected to said first and second side walls and separated from said third side wall by a third distance sufficient to enable one or more of the modules to be positioned between the third and fourth side walls, said fourth side wall having an upper edge adjacent the surface of the deck portion and a lower edge extending substantially vertically from the upper edge into the deck portion of the marine craft, said fourth side wall including a second plurality of guides protruding from and extending substantially vertically from the upper edge toward the lower edge of the fourth side wall, said second plurality of guides being oppositely oriented to said first plurality of guides and separated one from another by a fourth distance substantially equivalent to said second distance to produce a substantially identical set of alternating guides and troughs, wherein the distance separating a trough of the fourth side wall from an oppositely oriented trough of the third side wall and the distance separating each of said first plurality of guides from corresponding ones of said second plurality of guides being sufficient to enable the modules to can be slidingly fitted and contained in a vertical orientation between oppositely oriented troughs of said third and fourth side walls, and a bottom wall connected to the lower edges of said first, second, third, and fourth side walls and being substantially parallel to the deck portion of the marine craft, and a lid for covering said container, said lid being moveable between a fully open position providing access to the container and a fully closed position restricting access to the container, wherein said lid is substantially flush with the deck portion of the marine craft when the lid is in the fully closed position.

10. The storage compartment of claim 9 wherein each of said first and second plurality of guides includes eight guides for containing from about one to about nine modules.

11. The storage compartment of claim 9 wherein said first, second, third, and fourth side walls and said bottom wall are fabricated from polyethylene.

12. The storage compartment of claim 9, further comprising a raised edge adjacent the upper edges of said first, second, third, and fourth side walls to inhibit water intrusion into said container.

13. The storage compartment of claim 9 wherein said lid is movably attached to the deck of the marine craft by at least one hinge.

14. The storage compartment of claim 9 wherein each of said first plurality of guides extends beyond said third side wall about 0.45 inches and each of said second plurality of guides extends beyond said fourth side wall about 0.45 inches.

15. The storage compartment of claim 9 wherein the distance separating each of said first plurality of guides is about 2.43 inches and the distance separating each of said second plurality of guides is about 2.43 inches.

16. The storage compartment of claim 9 wherein said bottom wall is about 32.85 inches long and about 14.41 inches wide, and said third and fourth walls each are about 12.5 inches in height.

17. The storage compartment of claim 9 wherein said lid includes a handle.

18. The storage compartment of claim 9, further comprising a raised edge adjacent the upper edges of each of said side walls to inhibit intrusion of water into the container.

19. The storage system of claim 9 wherein said first, second, third, and fourth sidewalls are permanently attached by fiberglass to the understructure of the marine craft.

20. A fishing tackle storage system comprising:

a plurality of storage trays for storing fishing tackle including lures, each of said plurality of storage trays having a first end opposite a second end, a nonremovable storage tray container permanently attached to a deck of a marine craft and recessed into the deck to a depth at least as great as a dimension of a storage tray, said container including a first plurality of guides in opposed relation to a second plurality of guides, each of said first plurality of guides being in a spaced apart relation to receive and contain the first ends of said plurality of storage trays and each of said second plurality of guides being in a spaced apart relation to receive and contain the second ends of said plurality of storage trays, and a lid for covering said container, said lid being movable between an open position providing access to said container for placement and removal of storage trays, and a closed position restricting access to said container, wherein said lid is substantially flush with the deck of the marine craft when the lid is in its closed position.

21. The storage system of claim 20, further comprising a raised edge adjacent the upper edge of the container to inhibit intrusion of water into the container.

22. The storage system of claim 20 wherein each of said first and second plurality of guides includes eight guides for containing nine storage trays.

23. The storage system of claim 20 wherein each of said plurality of storage trays is about 13¾ inches in length, about 9⅛ inches in width, and about 2 inches in height.

24. The storage system of claim 20 wherein said storage tray container is permanently attached by fiberglass to the understructure of the marine craft.

25. A storage system for a marine craft having a deck with a deck surface, the system comprising:

a nonremovable recess defined in the deck and a plurality of storage modules removably positionable within the recess below the deck, said recess including:

a bottom wall spaced below the deck, a plurality of sidewalls extending from the bottom wall toward the deck surface, said sidewalls terminating adjacent and below the deck surface, and module retainers located within the recess for slidably receiving the modules and for maintaining the modules in a desired orientation within the recess below the deck surface.

26. The storage system of claim 25 wherein said recess and said modules are substantially rectangular in configuration.

27. The storage system of claim 25 wherein said bottom wall is substantially parallel to the deck surface and each of said plurality of side walls is substantially perpendicular to the bottom wall.

28. The storage system of claim 25 wherein said module retainers include projections extending perpendicularly from at least two side walls.

29. The storage system of claim 25 wherein said plurality of sidewalls is permanently attached by fiberglass to the understructure of the marine craft.

30. A boat comprising:

a deck, a nonremovable container recessed into said deck and configured to receive one or more tackle storage trays, said container being defined by:

a first side wall having an upper edge adjacent the surface of the deck and a lower surface extending substantially vertically from the upper edge into the deck of the boat, a second side wall opposite and substantially parallel to said first side wall and separated from said first side wall by a first distance defining a length of the container, said second side wall having an upper edge adjacent the surface of the deck and a lower surface extending substantially vertically from the upper edge into the deck of the boat, a third side wall having an upper edge adjacent the surface of the deck and a lower edge extending substantially vertically from the upper edge into the deck of the boat, said third side wall being connected to said first and second side walls, said third side wall including a first plurality of guides protruding from and extending substantially vertically from the upper edge toward the lower edge of the third side wall, wherein each of said guides is separated one from another by a second distance to produce alternating guides and troughs sized to receive at least a portion of one of the storage trays, a fourth side wall opposite and substantially parallel to said third side wall, said fourth side wall being connected to said first and second side walls and separated from said third side wall by a third distance sufficient to enable one or more tackle storage trays to be positioned between the third and fourth side walls, said fourth side wall having an upper edge adjacent the surface of the deck and a lower edge extending substantially vertically from the upper edge into the deck of the boat, said fourth side wall including a second plurality of guides protruding from and extending substantially vertically from the upper edge toward the lower edge of the fourth side wall, said second plurality of guides being oppositely oriented to said first plurality of guides and separated one from another by a fourth distance substantially equivalent to said second distance to produce a substantially identical set of alternating guides and troughs, wherein the distance separating a trough of the fourth side wall from an oppositely oriented trough of the third side wall and the distance separating each of said first plurality of guides from corresponding ones of said second plurality of guides being sufficient to enable storage trays to be slidingly fitted and contained between oppositely oriented troughs of said third and fourth side walls, and a bottom wall connected to the lower edges of said first, second, third, and fourth side walls and being substantially parallel to the deck portion of the boat, and a lid for covering said container, said lid being moveable between a fully open position providing access to the container and a fully closed position restricting access to the container, wherein said lid is substantially flush with the deck when the lid is in the fully closed position.

31. The boat of claim 30 wherein each of said first plurality of guides extends beyond said third side wall about 0.45 inches and each of said second plurality of guides extends beyond said fourth side wall about 0.45 inches.

32. The boat of claim 30 wherein said first, second, third, and fourth sidewalls are permanently attached by fiberglass to the understructure of the boat.

* * * * *